United States Patent [19]

Groothuis

[11] 4,427,300

[45] Jan. 24, 1984

[54] TIMEPIECE WITH A PERPETUAL CALENDAR MECHANISM

[75] Inventor: Michel Groothuis, Saint-Imier, Switzerland

[73] Assignee: Compagnie des Montres Longines, Saint Imier, Switzerland

[21] Appl. No.: 317,877

[22] Filed: Nov. 3, 1981

[30] Foreign Application Priority Data

Nov. 7, 1980 [CH] Switzerland ..... 8272/80

[51] Int. Cl.[3] ..... G04B 19/24

[52] U.S. Cl. ..... 368/37; 368/28

[58] Field of Search ..... 368/31, 34, 35, 37, 368/38

[56] References Cited

U.S. PATENT DOCUMENTS

| | | | |
|---|---|---|---|
| 387,005 | 7/1888 | Nilson . | |
| 527,386 | 11/1894 | Feishtinger . | |
| 2,470,692 | 5/1949 | Farr | 368/34 |
| 3,703,805 | 11/1972 | Ganter et al. | 368/34 |
| 3,751,901 | 8/1973 | Mentinger et al. | 368/38 |
| 3,939,645 | 2/1976 | Charbonney | 368/31 |
| 4,194,353 | 3/1980 | Thomi et al. . | |
| 4,234,943 | 11/1980 | Teramoto et al. | 368/35 |

FOREIGN PATENT DOCUMENTS

| | | |
|---|---|---|
| 2392430 | 5/1978 | France . |
| 318902 | 3/1957 | Switzerland . |
| 574125 | 9/1975 | Switzerland . |
| 621665 | 8/1981 | Switzerland . |
| 624533G | 8/1981 | Switzerland . |

*Primary Examiner*—Bernard Roskoski

*Attorney, Agent, or Firm*—Wender, Murase & White

[57] ABSTRACT

The mechanism comprises a date-disc (8) actuated at midnight by a lever (1) supporting a rotary part (3) with catches (3*a*) gearing with the wheel (4) of 24 h. The mechanism is so designed that each transition from a date to the next is effected in less than one hour so that the calendar remains still in synchronism with the hours hand, even in the case of the changing of the indication of time-zones. The disc comprises pins (14) controlling at the end of each month through a star-wheel (13) the rotation of a first (17) and a second (20) cam. The cams bear finger-pieces (17*a*,17*b*,21) the ones (17*a*,17*b*) of the first cam having variable widths according to the different lengths of the months forming bankings for a catch (9) of the lever (1) for hindering the return motion of this lever thus prolonging the duration of the gearing of the rotary part (3) with the disc (8). At the end of February of the normal years a finger-piece (17*b*) of the first cam (17) juxtaposes itself with a finger-piece (21) of the second cam (20) for causing the transition between the 28th of February and the 1st of March. This finger-piece (21) is missing in the leap years. The mechanism operates in the two directions of rotation of the wheel of 24 h.

8 Claims, 3 Drawing Figures

TIMEPIECE WITH A PERPETUAL CALENDAR MECHANISM

BACKGROUND OF THE INVENTION

The present invention relates to a timepiece with a perpetual calender mechanism comprising a date-disc, driving means for said date-disc and means driven at the end of each month by the date-disc, said means acting on said driving means for determining a number of steps of the displacement of said date-disc.

The mechanism makes use of a device of Longines described in the Swiss Pat. No. CH 621 665 and in the Swiss Published Patent Application No. CH 624 533 G. The particular nature of this mechanism is that it permits to effect a rapid changing of the date in both directions of rotation of the hours hand, e.g. when effecting a changing of the indication of time-zones at about midnight.

A mechanism for controlling a semi-perpetual calendar is known from the Swiss Pat. No. CH 574 125. This mechanism comprises a date-disc driving at the end of each month a star-wheel by means of four pins. The star-wheel drives a wheel assembled to a cam which determines the angle of rotation of a lever controlling in its turn the displacement by great or small steps of the date disc. However, the mechanism operates only in the normal direction of rotation of the hands of the timepiece and the setting of the date, the month and the year is difficult.

It is therefore the object of the present invention to provide a timepiece with a perpetual calendar mechanism operating in the two directions of rotation of the hands and in which the corrections of the date, the month and the year are rapid and easy to achieve.

SUMMARY OF THE INVENTION

The timepiece according to the invention is characterized in that said means acting on said driving means comprise a first cam called cam of the months making one turn in one year, said first cam comprising finger-pieces of different widths for determining different durations of action of said driving means, and a second cam called cam of the years making one turn in four years and comprising finger-pieces cooperating with said finger-pieces of the first cam for determining said durations of action of the driving means on the date-disc in accordance with the months of 28, 29, 30 and 31 days.

The invention will be described further by way of example in accordance with the accompanying drawings in which:

DESCRIPTION OF THE PREFERRED EMBODIMENT

Figure 1:
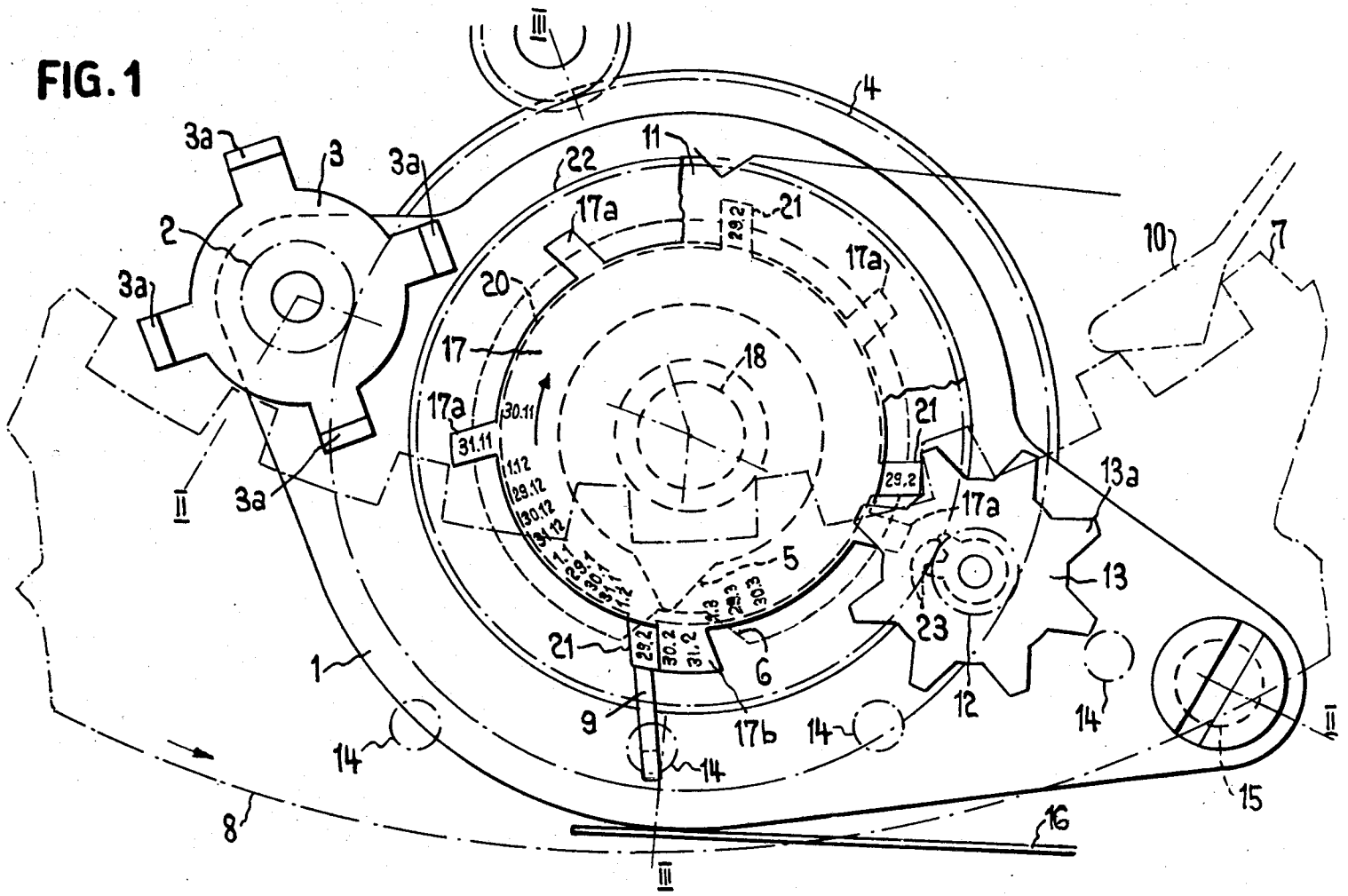
FIG. 1 shows the perpetual calendar mechanism according to the invention.

As indicated in FIG. 1 the mechanism comprises a lever 1 bearing a pinion 2 assembled with a rotary part 3 having four catches 3*a*. Lever 1 plots about pin 15 in an arcuate motion from an engaged position to a disengaged position. The pinion 2 makes a turn in four hours at maximum. It is driven by a wheel 4 making one turn in 24 hours and bearing a finger-piece 5 cooperating one time per day, at about midnight, with a projection 6 of the lever 1. The action of the finger-piece 5 on the projection 6 moves lever 1 to the engaged position and produces the depth of the catches 3*a* of the rotary part 3 in the spaces between the teeth 7 of the date-disc 8. Hence, in one hour (corresponding to a quarter of a turn of the pinion 2) a tooth of the date-disc has gone forward and the disc has moved of one step. Actually, due to the action of the jumper 10 the jump of the disc occurs when the tooth 7 driven by the catch 3*a* has moved of something more than one half of its step. After the finger-piece 5 has passed over the projection 6, the lever 1 rotating under the action of a return spring 16 disengages the catches 3*a* from the toothing of the date-disc. If at the end of the months (days 29, 30, 31 and 1) it is desired to make the date-disc jump of 2, 3 or 4 additional steps, i.e. of 2 steps for the months of 30 days (from 30 to 31 and from 31 to 1), of 4 steps for the month of February (from the 28 to 29, 29 to 30, 30 to 31 and 31 to 1), of 3 steps for the month of February of a leap year (from 29 to 30, 30 to 31 and 31 to 1) it suffices to maintain for the required time, i.e. for 1, 2 or 3 additional hours the lever 1 in its acting position by means of an appropriate program so that 2, 3 or 4 catches 3*a* drive 2, 3 or 4 additional teeth 7 of the date-disc 8.

To effect these particular function of variable ends of the months the lever 1 comprises a catch 9 cooperating with a cam of the months 17 coaxial with the 24 h-wheel 4 and having 48 steps at its periphery corresponding to 12 time 4 steps (28-29, 29-30, 30-31, 31-1 of each month). This cam 17 is assembled with a wheel 11 having 48 teeth driven tooth by tooth by a pinion 12 of 8 leaves assembled with a star-wheel 13 of 8 teeth (the assembly also known as first wheel means). The star-wheel 13 is driven by four pins or catches 14 mounted under the date-disc 8, the pitch between two successive pins being of 1/31 of a turn that is one pin per day for the days 29, 30, 31 and 1. Therefore, each time the star-wheel 13 advances of one step the cam 17 moves of one step.

OPERATION OF THE PERPETUAL CALENDAR MECHANISM

During 28 days the mechanism operates normally, one tooth 7 of the date-disc 8 being driven each day by a catch 3*a* of the rotary part 3 when the lever 1 is actuated by the action of the finger-piece 5 on the projection 6. The cam 17 with 48 steps is not rotated. The step corresponding to day 1 is positioned in front of the catch 9 of the lever 1. When the lever 1 turns about pin 15, the catch 9 is not hindered so that the return motion of the lever takes place normally. During these 28 days the cam 17 is not driven. At the time of the transition from 28 to 29 the first pin 14 of the date-disc 8 arrives in front of one tooth of the star-wheel 13. At the time of the jump from 28 to 29 caused by a catch 3*a* of the rotary part 3 the first pin 14 drives one tooth 13*a* of the star-wheel 13 and the cam 17 rotates, making one step. If 29 must be displayed (every month beside on February) the catch 9 is not hindered by the cam 17.

At the time of the jump from 29 to 30 caused by a catch 3*a* the second pin 14 drives the next tooth of the star-wheel 13 and the cam 17 rotates, making a further step. If 30 must be displayed (every month beside February) the catch 9 is not hindered by the cam 17.

At the time of the jump from 30 to 31 caused by a catch 3*a* the third pin 14 drives a further tooth of the star-wheel 13 and the cam 17 rotates of a further step. If 31 must be displayed (months of January, March, May, July, August, October and December) the catch 9 is not hindered by the cam 17. If 31 *must not* be displayed (months of February, April, June, September and November) the catch 9 is hindered by one, 17*a*, of the finger-pieces of the cam 17. Hence, the lever 1 cannot retire under the action of the spring 16 although the finger-piece 5 is disengaged from the projection 6 of the lever 1. The pinion 2 and its catches 3*a* remains therefore in engagement with the teeth 7 of the date-disc 8 so that one hour after the jump from 30 to 31 (a quarter of a turn of the pinion 2) a further catch 3*a* drives the next tooth 7 of the date-disc 8. At this time the fourth pin 14 drives the next tooth of the star-wheel 13 which causes the cam 17 to make a further step. Hence the date 1 of the next month is displayed. In this position of the cam 17 the catch 9 is released and the lever 1 retires normally, the catches 3*a* driving no more the teeth 7 of the date-disc 8. During the next 28 days the cam 17 is at rest because during this period of time the date-disc does not have any pin to present for driving the star-wheel 13. It is to be seen that for the months of 30 days the cam 17 comprises a finger-piece 17*a* for hindering the catch 9.

The mechanism described above may be used for realizing a semi-perpetual calendar providing the cam of the months comprises a finger-piece 17*b* having a width sufficient for hindering the catch 9 each year during four steps of the date-disc 8, hence permitting the transition from February 28 to March 1 to take place. The finger-piece should therefore have a width corresponding to four steps of the date-disc. However, such a device does not permit to realize a perpetual calendar which is the object of the invention so that for reasons which will be apparent later the finger-piece 17*b* of the cam 17 of FIG. 1 has actually a width corresponding to three steps of the displacement of the date-disc 8.

To realize a perpetual calendar, a programed control of every month during the cycle of four years, including the leap year is required.

Starting from the above described mechanism, the novelty consists to add a device for programing every four years a month of February ending with three jumps (29-30, 30-31, 31-1), the 29 being normally displayed, while for the three other years the program controls four jumps of the date-disc at the end of February (28-29, 29-30, 30-31, 31-1).

Such a system requires an element capable to distinguish between February of the leap year and February of the three normal years. To this end, a cam of the years 20 coaxial with the cam of the months 17 is provided, this cam 20 comprising three finger-pieces 21 arranged in such a manner as to enclose between them angular spaces of 90°, 90° and 180°. The cam 20 makes a turn in four years under the control of a wheel 22 (having the same diameter as the wheel 11) coaxial with the cam of the years 20 and having 48 teeth. The cam 20 is assembled with the wheel 22. This wheel 22 is driven by two adjacent teeth 23 assembled coaxially with the star-wheel 13 and the pinion 12. It has been shown above that the star-wheel 13 rotates of 4 teeth per month, accomplishing a full turn in 2 months. Hence, the two teeth 23 drive two teeth of the wheel 22 every two months. The cam 20, assembled to the wheel 22 makes therefore one turn every 4 years.

The three finger-pieces 21 of the cam 20 are similar to the ones 17*a* of the cam 17 of FIG. 1. They achieve also the same function which means that when the program it so requires they hinder the return motion of the catch 9 of the lever 1 which blocks the return of this lever.

In this embodiment, as mentioned previously the cam of the months 17 comprises for the month of February a finger-piece 17*b* having a width corresponding to three steps of the displacement of the date-disc 8. The fourth step which is required for the normal years having a month of February of 28 days is produced by one of the finger-piece 21 of the cam of the years 20. This finger-piece 21 is juxtaposed at the end of February to the finger-piece 17*b* of the cam of the months 17 for presenting to the catch 9 a hindering width corresponding to four steps of the fast moving date-disc 8.

Hence, at the time of the jump from 28 to 29 the cam 20 presents a finger-piece 21 which hinders the catch 9 of the lever 1. Therefore, the 29 jumps at midnight. At the transition from 29 to 30 (which must not be displayed) it is the finger 17*b* of the cam 17 which hinders the catch 9 and the 30 jumps therefore one hour after the 29. At the transition from 30 to 31 (which must not be displayed) the finger-piece 17*b* hindering the catch 9 is still present and the 31 jumps therefore two hours after the 29. At the transition from 31 to 1 (which must be displayed) the finger-piece 17*b* hindering the catch 9 is still present so that the date-disc 8 jumps from the 31 to 1 three hours after the jump from the 28 to 29.

Hence, the finger-piece 21 of the cam 20 controls one step and the finger-piece 17*b* of the cam 17 three steps, together also the four steps (4/48 of a turn) required for the transition between February 28 and March 1 of each normal year. For the leap year in which February 29 must be displayed the finger-piece 21 is missing on the cam 20 which permits the normal display of the date 29 followed by the rapid transition to the 1st March.

Figure 2:
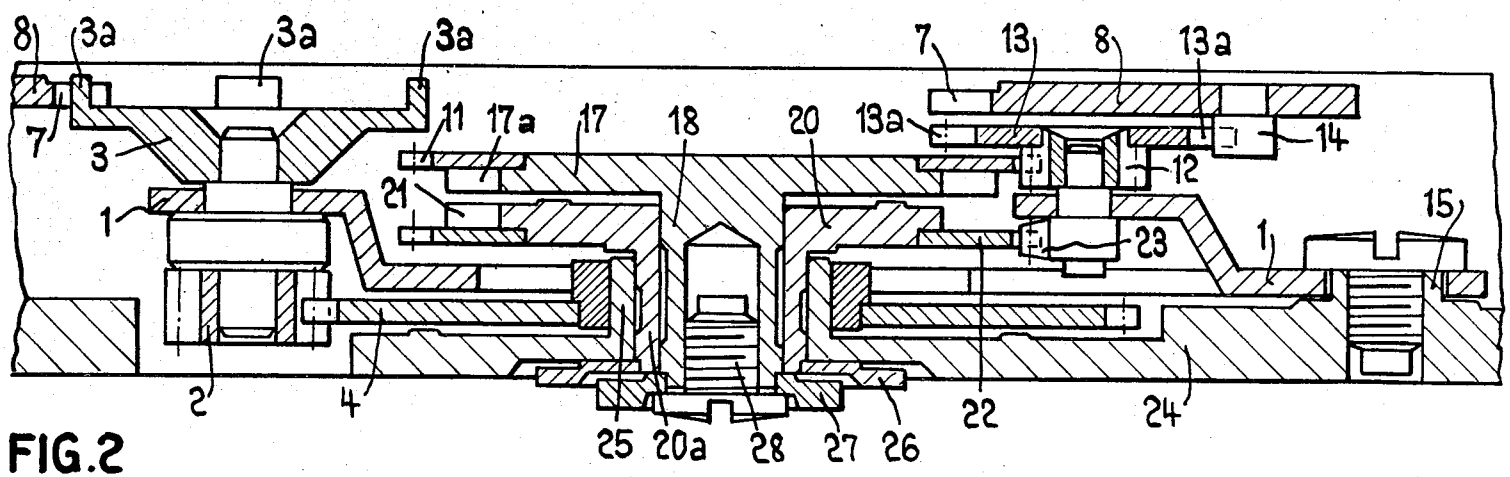
FIG. 2 shows a section across the line II—II of the mechanism of FIG. 1.

FIGS. 1 and 2 show that the actuation of the lever 1 by the finger-piece 5 of the wheel 4 of 24 h acting on the projection 6 is symmetrical. There exists a second symmetry of the displacement of the date-disc 8 by the catches 3*a* of the rotary part 3 and a third symmetry of the actuation of the star-wheel 13 by the pin 14 of the date-disc 8. This means that the mechanism operates indifferently in both directions of rotation of the hands of the timepiece, more particularly in both directions of rotation of the hours hand, e.g. at the time of the changing of the indication of a time-zone. More precisely, every change of the indication of the time-zones effected during the period of three hours (time during which the display indicates successively 29, 30 and 31) required for the transition between February 28 and March 1 of each normal year causes simply the display of the date to change forward or backward according to the direction of rotation of the hours hand.

Figure 3:
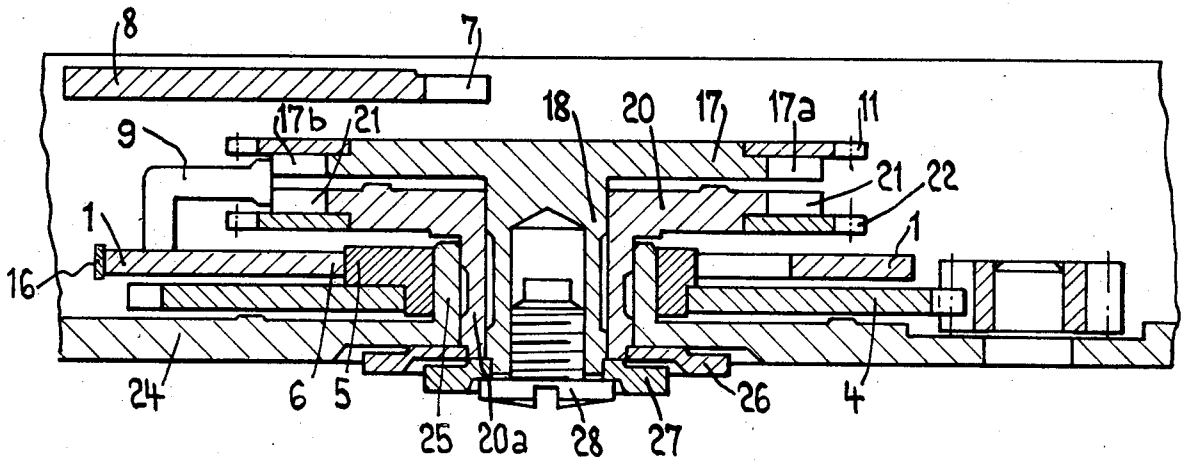
FIG. 3 shows a section across the line III—III of the mechanism of FIG. 1.

FIGS. 2 and 3 show sections through the mechanism of FIG. 1. These FIGS. 2 and 3 are intended to facilitate the understanding of the setting of the date, the month and the year, e.g. at the time of the replacement of the battery of an electronic timepiece.

In this mechanism the plate or bridge 24 comprises a tube 25 on or in which turn all coaxial rotary parts of the system, that is the wheel 4 of 24 h assembled with the finger-piece 5 and the cam of the years 20 on which is mounted the driving wheel 22 of 48 teeth. This cam 20 comprises a bush 20*a* which turns in the tube 25 and supports a display disc 26 bearing the indications of the four years of the cycle (three normal and one leap year). The cam of the months 17 bearing the wheel 11 of 48 teeth comprises a bush 18 which also rotates about the axis of the tube 25. This bush 18 supports a display disc of the months 27 bearing the indications of the 12 months of the year. A screw 28 is screwed in the bush 18 for assembling the whole to the tube 25.

The wheel 11 of the months gears with the pinion 12 of 8 leaves assembled with pinion bearing the two teeth 23 gearing with the wheel 22.

For effecting the setting of the date, the month and the year of the perpetual calendar, e.g. at the time of the replacement of the battery of an electronic timepiece, one proceeds as follows.

(a) setting of the desired date by actuating the wheel 4 so that the finger-pieces 3*a* of the rotary part 3 drives the date-disc 8 through its teeth 7. The 24 h-wheel 4 is manually actuated by the crown of the timepiece, preferably in its special position provided for changing the indication of the time-zones. In this position the crown actuates only the hours hand.

(b) rotatively actuating the disc of the months 27 which in its turn drives through the double pinion 12–23 the wheel of the years 22 with a ratio of 4 to 1. Hence, it suffices to rotate manually the disc of the months 27 supported by the cam of the months 17 until the disc of the years 26 supported by the cam of the years 20 arrives in the right year (fixed adjusting mark on the bridge 24) with respect to the leap year. The rotation of the disc 27 is then continued until the setting of the desired month is achieved (with respect to the fixed adjusting mark).

The manual actuation of the disc of the months 27 gives rise to no difficulties since at the time of the setting of the date and the year or at the time of the replacement of the battery of an electronic timepiece the back cover of the case is removed. The disc 27 is therefore directly accessible because it is disposed facing this back cover.

However, the actuation of the disc of the months should not take place before the lever 1 has been placed in its remote position (corresponding to the position reached at midnight by the finger-piece 5 acting on the projection 6) by means of a simple device not represented, so that the finger-pieces 17*a*, 17*b* and 21 of the cams 17 and 20 are not hindered in their motion by the catch 9.

The preceding shows that the setting of the date, the month and the year is rapid and easy to achieve. Due to the symmetry of the mechanism the crown and the disc of the months 27 may be actuated in both directions of rotation, which further facilitates the operation.

What I claim:

1. An improved timepiece with a perpetual calendar mechanism of the type having a rotationally displaceable date-disc for indication of the date of the month, said date-disc being moveable in discrete angular displacement steps, drive means for rotating said date-disc and determining means for determining the number of displacement steps of said date-disc, said determining means being driven at the end of each calendar month by said date-disc and cooperating with said drive means so that said date-disc indicates the transition from the end of the month to the beginning of the next month, wherein the improvement comprises said determining means having:

(a) a months cam rotatable one full turn per year, said months cam having an outer periphery and month finger-pieces radially projecting from said periphery for sweeping a rotational path and for interaction with said drive means, each of said month finger-pieces having different angular widths for determining different durations of interaction with said drive means; and (b) a years cam rotatable one full turn in four years having an outer periphery and year finger-pieces radially projecting from said periphery for sweeping a rotational path cooperating with said month finger-pieces and said drive means for determining the number of date-disc rotation steps necessary to indicate the last day of the month and activate the drive means in order to advance the date-disc to the first date of the month even during leap years.

2. The improvement according to claim 1 wherein said timepiece has an hours hand, said date-disc drive means has a rotating drive gear with four radially extending catches for engagement with the date-disc, said gear rotating one turn in four hours and means for engaging said date-disc by said drive gear when said hours hand indicates the end of a day, said means for engaging said date-disc cooperating with said hours hand.

3. The improvement according to claim 1 wherein said drive means comprises:

(a) a lever having a pivotally fixed end and a free end for arcuate motion about said fixed end from an engaged position to a disengaged position;

(b) lever drive means attached to said lever for driving said date-disc when said lever is in the engaged position;

(c) a catch attached to said lever positioned in the rotational path of said finger-pieces of said cams, said catch abutting a finger-piece when one of said finger-pieces rotates to a position proximate said catch, said abutment preventing motion of said lever from the engaged to the disengaged position;

(d) a first wheel means for driving said month and year cams; and (e) date-disc pins attached to said date-disc and driving said first wheel means each month so that rotation of said month and year cams by said first wheel means advances said finger-pieces on both of said cams, said finger-pieces abutting said catch when in proximity therewith and blocking disengagement of said lever in order to maintain said lever drive means in engagement with said date-disc.

4. The improvement according to claim 3 wherein said first wheel means comprises a first wheel for driving said months cam in a relative ratio with respect to the years cam.

5. The improvement according to claim 4 wherein said first wheel means for driving said months cam also comprises a pinion coaxially attached to said first wheel and having teeth on only a portion of its periphery for driving said years cam wheel, said years cam wheel cooperating with said years cam.

6. The improvement according to claim 1 wherein (a) the months and years cams are driven by a first wheel means which rotates said months cam one turn per year and which rotates said years cam one turn per four years;

(b) months display means indicates months cam rotational position and cooperates with the months cam, said months cam being capable of manual rotation, both clockwise and counterclockwise, by said months display means for positioning the cam to the desired month position; and (c) years display means indicates said years cam rotational position and cooperates with said years cam.

7. The improvement according to claim 6 wherein (a) said months display means is a months indicator disc, said months indicator disc being coaxially connected to said months cam by a bushing and accessible for timepiece setting of date, month and year by removal of a timepiece cover; and (b) said years display means is a years indicator disc, said years indicator disc being coaxially connected to said years cam by a bushing.

8. The improvement according to claim 1 of the type having date-disc drive means cooperating with and controlled by a timepiece hours hand when manually setting the time, wherein the improvement further comprises the date-disc drive means cooperating with said date-disc to advance or recede the date-disc between any two months in response to advancement or recession of said hours hand.

* * * * *

UNITED STATES PATENT AND TRADEMARK OFFICE

CERTIFICATE OF CORRECTION

PATENT NO. : 4,427,300

DATED : January 24, 1984

INVENTOR(S) : MICHEL GROOTHUIS

It is certified that error appears in the above—identified patent and that said Letters Patent is hereby corrected as shown below:

Title page, left column under the heading "Assignee", the name "Compagnie des Montres Longines" should be -- Compagnie des Montres Longines Francillon SA --.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*